US005599166A

United States Patent [19]

Deptowicz et al.

[11] Patent Number: 5,599,166

[45] Date of Patent: Feb. 4, 1997

[54] CORE FOR FABRICATION OF GAS TURBINE ENGINE AIRFOILS

[75] Inventors: Donald L. Deptowicz, Hamden, Conn.; Friedrich O. Soechting, Tequesta, Fla.

[73] Assignee: United Technologies Corporation, Hartford, Conn.

[21] Appl. No.: 333,157

[22] Filed: Nov. 1, 1994

[51] Int. Cl.[6] ..... F01D 5/18

[52] U.S. Cl. ..... 416/97 R; 164/369

[58] Field of Search ..... 416/97 R; 415/115; 164/369

[56] References Cited

U.S. PATENT DOCUMENTS

| | | | |
|---|---|---|---|
| 3,965,963 | 6/1976 | Phipps et al. | 164/60 |
| 4,148,350 | 4/1979 | Rossmann | 164/132 |
| 4,596,281 | 6/1986 | Bishop | 164/369 |
| 4,627,480 | 12/1986 | Lee | 164/369 |
| 5,050,665 | 9/1991 | Judd | 164/369 |
| 5,337,805 | 8/1994 | Green et al. | 164/369 |
| 5,403,159 | 4/1995 | Green et al. | 416/97 R |

*Primary Examiner*—Edward K. Look
*Assistant Examiner*—Mark Sgantzos
*Attorney, Agent, or Firm*—Marina F. Cunningham

[57] ABSTRACT

An airfoil (20) for a gas turbine engine (10) includes cooling passages (40), (50) extending radially within the airfoil to circulate cooling air therethrough. Pluralities of small cross-over holes (48), (66), (72) are formed within the walls (50), (68), (74), respectively, to allow cooling air to flow between the cooling passages. Optimum stiffness parameters are provided to improve producability of the airfoils with small geometric features, such as the crossover holes, as well as to improve the overall cooling scheme without jeopardizing manufacturability of airfoils.

3 Claims, 3 Drawing Sheets

CORE FOR FABRICATION OF GAS TURBINE ENGINE AIRFOILS

The invention was made under U.S. Government contract and the Government has rights herein.

TECHNICAL FIELD

This invention relates to gas turbine engines and, more particularly, to the fabrication of airfoils therefor.

BACKGROUND OF THE INVENTION

Conventional gas turbine engines include a compressor, a combustor, and a turbine. Air flows axially through the sections of the engine. As is well known in the art, air compressed in the compressor is mixed with fuel which is burned in the combustor and expanded in the turbine, thereby rotating the turbine and driving the compressor. The turbine components are subjected to a hostile environment characterized by the extremely high temperatures and pressures of the hot products of combustion that enter the turbine. In order to withstand repetitive thermal cycling in such a hot environment structural integrity and cooling of the turbine airfoils must be optimized.

Cooling schemes for airfoils have become very sophisticated in modem engines. The airfoils include intricate internal cooling passages that extend radially within the very thin airfoil. The radial passages are frequently connected by a plurality of small crossover holes to allow the flow of cooling air between the passages. Fabrication of airfoils with such small internal features necessitates a complicated multistep manufacturing process.

A problem with the current manufacturing process is that it is characterized by relatively low yields. The main reason for the low yields is that during the manufacturing process of airfoils, a ceramic core, that defines the cooling passages of the airfoil, often either breaks or fractures. There are a number of factors that contribute to such a high percentage of ceramic cores becoming damaged. First, ceramic, in general, is a brittle material. Second, the airfoils are very thin and subsequently, the cores are very thin. Finally, the small crossover holes in the airfoil result in narrow fingers in the core that are easily broken under load.

Another major factor contributing to cores being damaged during airfoil fabrication is that the fragile cores are handled repeatedly, undergoing many manufacturing processes, thereby increasing the chances for the core to break. In such processes, the core is first manually removed from a die and can be easily broken during handling. Subsequently, the core is secured within a mold and pressurized wax is injected into the mold around the core. As the pressurized wax is injected around the core, the core is subjected to shearing, bending and torsion loads that may either crack or break the core. The wax mold, with the core secured inside, is then dipped into a slurry to form layers of coating or a "shell". The wax is then melted out from the shell, forming a mold with the core secured therein. The shell, with the core secured therein, is subsequently heated. The heating process of the shell with the core results in different rates of expansion of the ceramic core and the shell. The difference in growth of the shell and the core frequently results in the core being fractured or broken since the shell generally expands at a faster rate than the core, thereby stretching the core and breaking it. The next step in the manufacturing process is injecting molten metal into the shell with the core secured therein. As the molten metal is poured into the shell, it may have non-uniform flow, causing shear, bending, and torsion loads on the core. As the molten metal solidifies, the core is then chemically removed from the airfoil. Once the core is removed, the area occupied by the core becomes the internal cavity for cooling air to pass through within the airfoil.

Fractures or breakage of the core during the manufacturing process is frequently detected only after the part is completed. Even a hairline fracture in the core developed at any stage of the manufacturing process will undermine the integrity of an airfoil and result in necessary of scrapping the finished part. One financial disadvantage of obtaining a low yield of good parts is that the effective cost of each usable airfoil is very high.

Another drawback is that the fragile nature of the ceramic cores results in producability constraints that limit more optimal cooling schemes. In many instances it may be more advantageous for the airfoil cooling and engine efficiency to have smaller crossover holes or more intricate geometric features. However, more intricate cooling passages are not practical at this time, since the current manufacturing process already yields an insufficiently small number of usable airfoils and has a high percentage of ceramic cores being damaged. More intricate cooling schemes would result in even lower manufacturing yields and even higher cost per airfoil. Thus, there is a great need to improve manufacturability of the gas turbine engine airfoils to reduce the cost of each airfoil as well as to improve cooling schemes therefor.

DISCLOSURE OF THE INVENTION

It is an object of the present invention to improve the manufacturing process of a gas turbine engine airfoil.

It is a further object of the present invention to minimize the breakage and fracturing of ceramic cores during the manufacturing process of the gas turbine engine airfoil.

It is another object of the present invention to optimize use of the cooling air in gas turbine engine airfoils and thereby improve engine efficiency.

According to the present invention, improved yields in the manufacture of gas turbine engine airfoils including a plurality of radially extending cooling passages with some of the cooling passages connected by a plurality of crossover holes, are obtained by fabricating the airfoils with removable ceramic cores, that define the cooling passages, the ceramic cores including radial rows of fingers, each row having the following optimum stiffness parameters:

$A_{tot}/L \geqq 6.5\times10^{-2}$, $XL/I_{total} \leqq 2.7\times10^{6}$, and $L/I_{min} \leqq 2\times10^{7}$, wherein $A_{tot}$ is the total transverse cross-sectional area of the row of fingers; L is the total length of the row of fingers; X is the distance from the centerline of the row passing radially therethrough to the nearest of the trailing edge or leading edge of the ceramic core (moment arm); $I_{tot}$ is the total sum of all moments of inertia taken at each finger of the row along the centerline thereof; and $I_{min}$ is the moment of inertia of the smallest finger at the ends of the row of fingers.

The optimum stiffness parameters improve manufacturability process of airfoils by reducing the failure rate in ceramic cores that define hollow cooling passages within the airfoils. The reduced failure rate of ceramic cores results in a higher yield of good airfoils during the manufacturing process and subsequently reduces the manufacturing cost per airfoil.

Furthermore, the stiffness parameters allow unprecedented flexibility in the cooling scheme for the airfoil. The use of cooling air within the airfoil can be optimized by choosing the location, size, and shape of the crossover holes, provided that the stiffness parameter constraints are adhered to. Thus, the ceramic cores for the gas turbine engine airfoil having these optimum stiffness parameters for torsion load, shear load, and bending load, respectively, result in improved casting yields as well as more efficient use of cooling air.

The foregoing and other objects and advantages of the present invention become more apparent in light of the following detailed description of the exemplary embodiments thereof, as illustrated in the accompanying drawings.

BEST MODE FOR CARRYING OUT THE INVENTION

Figure 1:
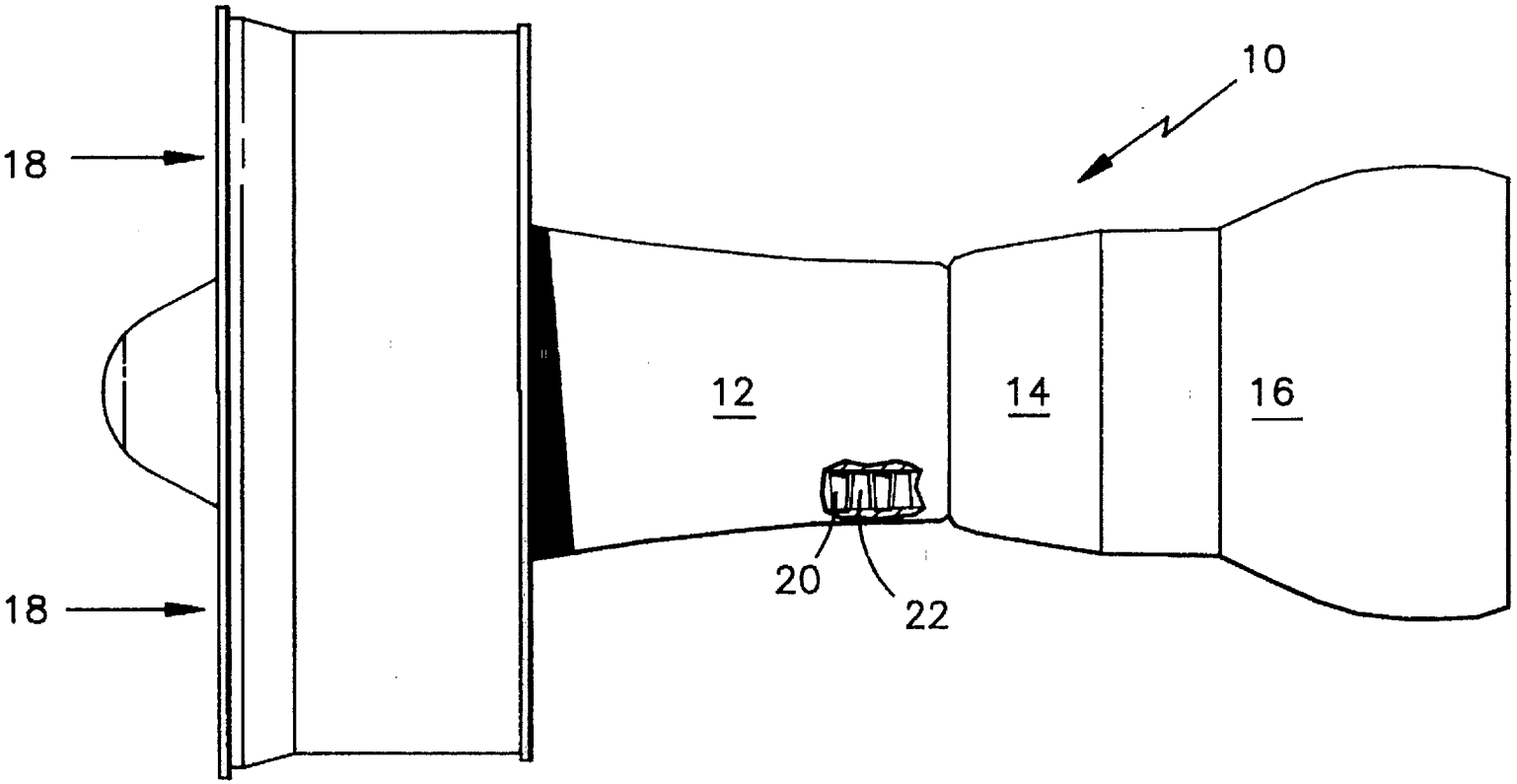
FIG. 1 is a simplified, broken away elevation of a gas turbine engine.

Referring to FIG. 1, a gas turbine engine 10 includes a compressor 12, a combustor 14, and a turbine 16. Air 18 flows axially through the sections 12, 14, 16 of the engine 10. As is well known in the art, air 18, compressed in the compressor 12, is mixed with fuel which is burned in the combustor 14 and expanded in the turbine 16, thereby rotating the turbine 16 and driving the compressor 12.

Both the compressor 12 and the turbine 16 are comprised of rotating and stationary airfoils 20, 22, respectively. The airfoils, especially those disposed in the turbine 16, are subjected to repetitive thermal cycling under widely ranging temperatures and pressures. To avoid burning of the airfoils, each airfoil 20 includes internal cooling.

Figure 2:
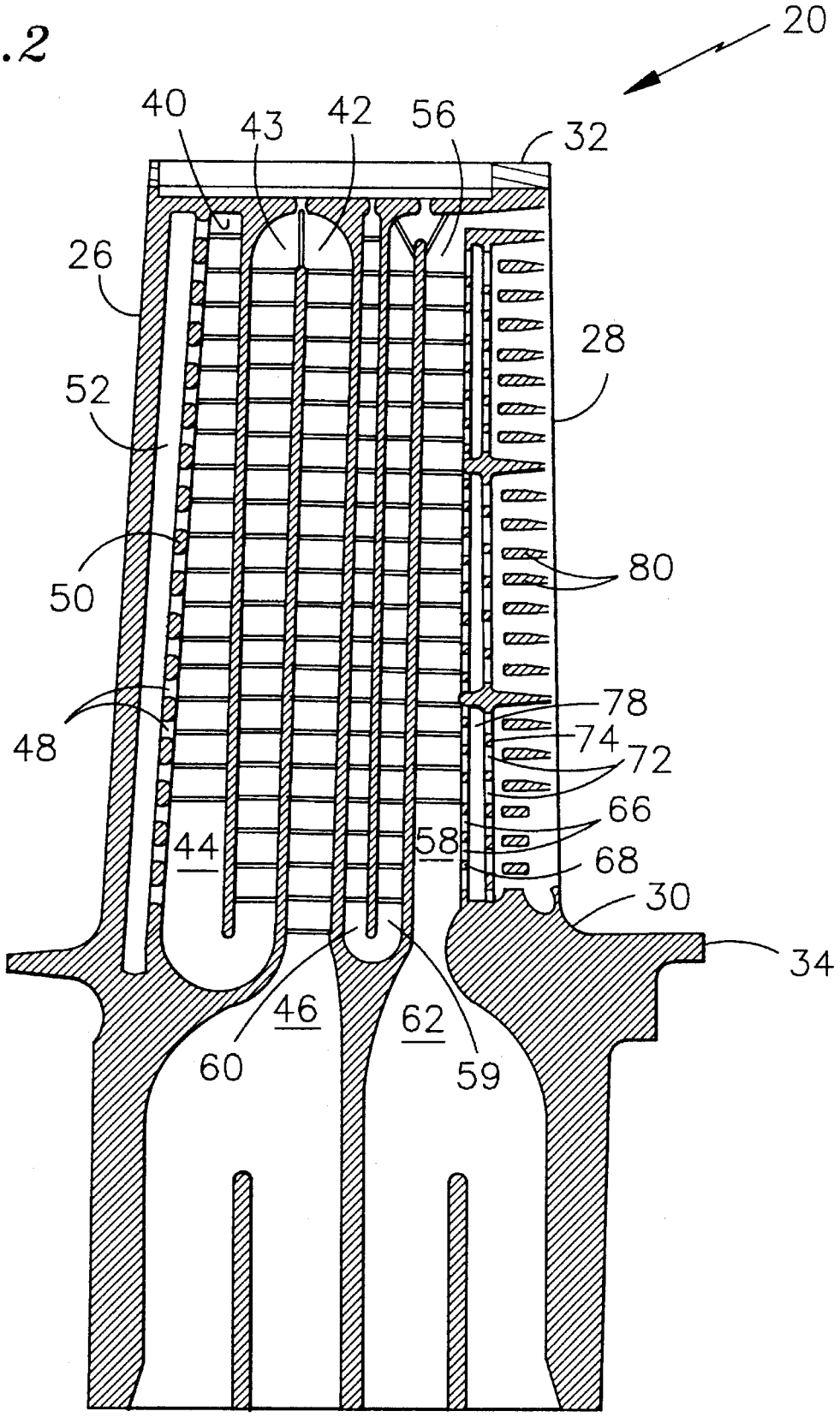
FIG. 2 is an enlarged, cross-sectional elevation of an airfoil of the gas turbine engine of FIG. 1.

Referring to FIG. 2, the airfoil 20 includes a leading edge 26 and a trailing edge 28 extending from a root end 30 to a tip 32 thereof and a platform 34. A leading edge cooling passage 40 is formed within the leading edge 26 of the airfoil 20 having radially extending, connected channels 42–44 and a leading edge inlet 46, formed within the platform 34 and in fluid communication with the channel 42. A plurality of leading edge crossover holes 48 formed within a leading edge passage wall 50 separating the channel 4 from a leading edge exhaust passage 52, allow the cooling air from the channel 44 to flow into the leading edge exhaust passage 52.

A trailing edge cooling passage 56 is formed within the trailing edge 28 of the airfoil 20 having radially extending, connected channels 58–60 and a trailing edge inlet 62 formed within the platform 34 and in fluid communication with the channel 58. A first plurality of trailing edge crossover holes 66 is formed within a first trailing edge wall 68 and a second plurality of trailing edge crossover holes 72 is formed within a second trailing edge wall 74 to allow cooling air from channel 58 to flow through an intermediate passage 78 to a plurality of trailing edge slots 80.

Figure 4:
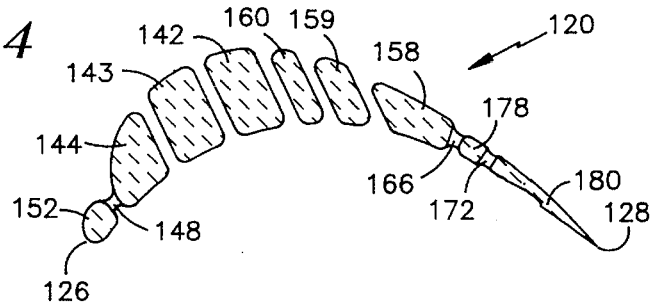
FIG. 4 is a cross-sectional elevation of the ceramic core taken in the direction of line 4—4 in FIG. 3.
Figure 3:
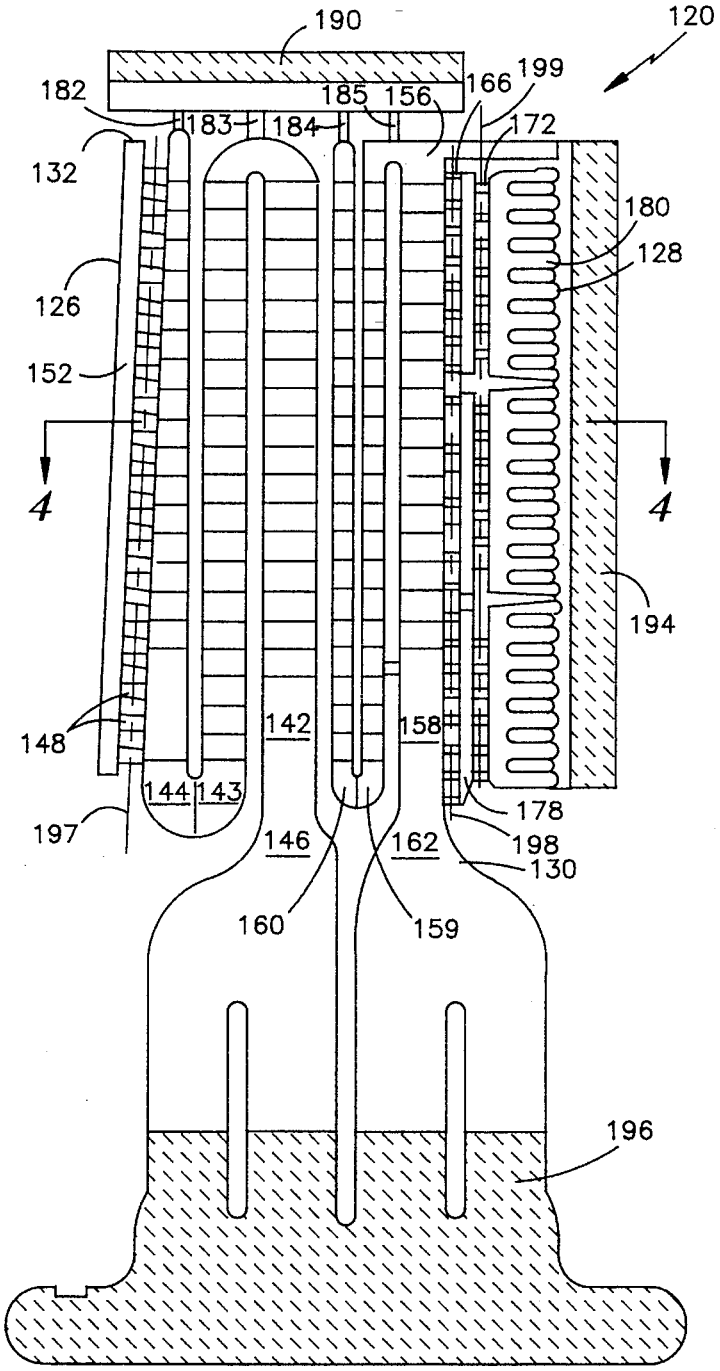
FIG. 3 is an elevation of a ceramic core defining cooling passages for manufacturing of the airfoil of FIG. 2 according to the present invention.

A ceramic core 120, as depicted in FIGS. 3 and 4, is used in the manufacturing process of the airfoils 20 and defines the hollow cavities therein. A ceramic core leading edge 126 and a ceramic core trailing edge 128 correspond to the leading edge 26 and trailing edge 28 in the airfoil 20, respectively. A ceramic core root 130 and a tip 132 correspond to the airfoil root 30 and tip 32, respectively. Ceramic core passages 140, 156 with channels 142–144, 158–160, and inlets 146, 162 respectively, correspond to passages 40, 56 with channels 42–44, 58–60 and inlets 46, 62, of the airfoil, respectively. Passages 52 and 78 of the airfoil correspond to channels 152 and 178 in the ceramic core. Pluralities of fingers 148, 166, 172 in the core 120 correspond to the plurality of crossover holes 48, 66, 72 in the airfoil 20, respectively. A core tip 190 is attached to the core passages 140, 156 by means of fingers 182–185, to stabilize the core 120 at the tip 132. An external ceramic handle 194 is attached at the core trailing edge 128 for handling purposes. A core extension 196 defines a cooling passage at the root to the airfoil 20. Centerlines 197–199 extend radially through each row of fingers 148, 166, 172, respectively.

Each row of fingers 148, 166, 172 has two end fingers, with each end finger being either the most radially outward or the most radially inward finger in the row. Each row of fingers 148, 166, 172 meets the following optimum stiffness parameters:

$A_{tot}/L \geqq 6.5\times10^{-2}$, $XL/I_{total} \leqq 2.7\times10^{6}$, and $L/I_{min} \leqq 12\times10^{7}$, wherein $A_{tot}$ is the total transverse cross-sectional area of the row of fingers; L is the total length of the row of fingers 148, 166, 172, respectively; X is the distance from the centerline of the row to the nearest of the leading edge 126 or the trailing edge 128, including any additional pieces of ceramic, such as external ceramic handle 194 (moment arm); I is the moment of inertia or also called section property, with $I_{min}$ being the moment of inertia of the smallest finger at the ends of the row of fingers, and $I_{total}$ being the total sum of all moments of inertia taken at each finger of the row. Each cross-section may have a different moment of inertia or section property, I, depending on the specific geometric shape thereof. For example, a rectangular cross-section has moment of inertia equal $bh^3/12$, wherein b is the width of the rectangle and h is the length thereof.

$A_{tot}/L$ represents shear loading that is caused by differential growth of the core and shell. By maximizing the shear area per unit length, the likelihood for failure due to shear loading is diminished. $L/I_{min}$ parameter represents torsion loading. By minimizing $L/I_{min}$, the edge breakage is minimized. $XL/I_{tot}$ represents bending that is caused by a load at the trailing edge that results in the fracture of the trailing edge. By minimizing this parameter the ceramic core features at the trailing and leading edges become stiffer.

In order to withstand harsh operating conditions within the turbine 16, in addition to having the internal cooling passages, each airfoil must be free from flaws. Fabrication of the core 120, is the first step in the lengthy manufacturing process of the airfoil 20 and is a critical step in the process. The core 120 defines the hollow cavities of the airfoil 20. The core 120 is generally fabricated from ceramic and is extremely fragile for a number of reasons. First, the ceramic is a brittle material. Second, the airfoil 20 is very thin and therefore, the core is also very thin. Finally, the crossover holes 48,66,72 in the airfoil 20 have very small diameters, thereby resulting in very small diameters in the fingers 148,166,172 in the core 120. The risk of fracturing or breaking the core increases since each core is subjected to many intermediate processes and manipulations during the manufacturing thereof.

The fractures in the core developed during the manufacturing process cannot be detected until the finished part is inspected. If the core develops even a hairline fracture during any stage of airfoil fabrication, the resulting airfoil is relegated to scrap. Thus, the integrity of the core must remain intact throughout the entire process.

The core of the present invention, adhering to the stiffness parameters, can withstand bending, shear, and torsion loading much better than cores not adhering to these stiffness parameters. A higher percentage of cores of the present invention endure the manufacturing process without developing fractures, therefore resulting in a higher yield of useable airfoils and lower costs for each airfoil. Furthermore, the tradeoff between the size, shape, and location of the crossover holes in the airfoils and fingers in the core with respect to the edge, allows selection of an optimal cooling scheme without jeopardizing the producability of the core and airfoils. For example, crossover holes/fingers can be made with smaller diameters if they are located further away from the edge of the core. Also, by varying the cross-sectional shape of the crossover holes/fingers, the moment of inertia changes, thereby allowing the operator to change the size of the holes and their location. Thus, the design parameters for the core improve durability of cores, as well as optimize the use of cooling airflow by tailoring it to the specific needs of the airfoils.

Although the invention has been shown and described with respect with exemplary embodiments thereof, it should be understood by those skilled in the art that various changes, omissions, and additions may be made thereto, without departing from the spirit and scope of the invention.

We claim:

1. An airfoil for a gas turbine engine having a leading edge and a trailing edge extending from a root to a tip, said airfoil having a plurality of radially extending cooling passages, some of said cooling passages being connected by a plurality of crossover holes allowing flow of air therebetween, said airfoil fabricated from a core having a plurality of core passages representing said plurality of cooling passages of said airfoil and a row of fingers representing said plurality of crossover holes of said airfoil, each said row of fingers having a centerline passing radially therethrough, said airfoil characterized by:

said core having each said row of fingers having $A_{tot}/L \geqq 6.5\times10^{-2}$, $XL/I_{total} \leqq 2.7\times10^{6}$, and $L/I_{min} \leqq 12\times10^{7}$, wherein $A_{tot}$ is the total transverse cross-sectional area of said row of fingers; L is the total length of said row of fingers; X is the distance from said centerline of said row passing radially therethrough to the nearest of said trailing edge or said leading edge of said core; $I_{tot}$ is the total sum of all moments of inertia taken at each said finger of said row of fingers along said centerline thereof; and $I_{min}$ is file moment of inertia of the smallest said finger at the ends of said row of fingers.

2. A core for fabrication of gas turbine engine airfoils having a leading edge and a trailing edge, said core having a plurality of radially extending core passages, some of said core passages connected by a row of fingers, said core passages defining cooling passages within said airfoil, said fingers defining crossover holes within said airfoil, each said row of fingers having a centerline extending radially therethrough, said core characterized by:

$A_{tot}/L \geqq 6.5\times10^{-2}$, $XL/I_{total} \leqq 2.7\times10^{6}$, and $L/I_{min} \leqq 12\times10^{7}$, wherein $A_{tot}$ is the total transverse cross-sectional area of said row of fingers; L is the total length of said row of fingers; X is the distance from said centerline of said row passing radially therethrough to a nearest of said trailing edge or said leading edge of said core; $I_{tot}$ is the total sum of all moments of inertia taken at each said finger of said row of fingers along said centerline thereof; and $I_{min}$ is the moment of inertia of the smallest said finger at the ends of said row of fingers.

3. The core of claim 2 further characterized by said core being fabricated from ceramic.

* * * * *